US007146888B2

(12) United States Patent
Martinka

(10) Patent No.: US 7,146,888 B2
(45) Date of Patent: Dec. 12, 2006

(54) ADJUSTABLE PLIERS

(75) Inventor: Charles Martinka, Berwyn, IL (US)

(73) Assignee: Adjustable Clamp Company IL (US)

( * ) Notice: Subject to any disclaimer, the term of this patent is extended or adjusted under 35 U.S.C. 154(b) by 0 days.

(21) Appl. No.: 09/997,805

(22) Filed: Nov. 30, 2001

(65) Prior Publication Data

US 2003/0101852 A1 Jun. 5, 2003

(51) Int. Cl.
*B25B 7/04* (2006.01)

(52) U.S. Cl. ..... 81/407; 81/355; 81/358; 81/411; 81/413; 81/416; 81/417; 81/427; 81/385; 81/900

(58) Field of Classification Search ..... 81/355, 81/358, 407, 411, 413, 417, 416, 427, 385, 81/900

See application file for complete search history.

(56) References Cited

U.S. PATENT DOCUMENTS

| | | | | | |
|---|---|---|---|---|---|
| 284,933 | A | * | 9/1883 | Wilbur | 81/411 |
| 588,991 | A | | 8/1897 | Henderson | |
| 666,433 | A | | 1/1901 | Odegaard | |
| 870,510 | A | | 11/1907 | Hartridge et al. | |
| 1,207,947 | A | * | 12/1916 | Litchfield | 81/427 |
| 1,332,140 | A | | 2/1920 | Norgord | |
| 1,508,510 | A | | 9/1924 | Edwards | |
| 4,296,655 | A | | 10/1981 | Tesoro | |
| 4,429,460 | A | * | 2/1984 | Hill et al. | 81/412 |
| 4,563,921 | A | | 1/1986 | Wallace | |
| 4,651,598 | A | | 3/1987 | Warheit | |
| 4,669,340 | A | | 6/1987 | Igarashi | |
| 4,890,519 | A | | 1/1990 | LeDuc | |
| 4,901,609 | A | | 2/1990 | Crum | |
| 4,903,558 | A | | 2/1990 | LeDuc | |
| 4,922,770 | A | | 5/1990 | Dlugolecki et al. | |
| 4,944,204 | A | | 7/1990 | West | |
| 4,957,020 | A | | 9/1990 | Monceret | |
| 5,020,399 | A | | 6/1991 | Annis et al. | |
| 5,660,089 | A | | 8/1997 | Chow | |
| 5,970,827 | A | | 10/1999 | Lin | |
| D415,939 | S | | 11/1999 | Staton | |
| D416,179 | S | | 11/1999 | Staton et al. | |
| 6,014,917 | A | | 1/2000 | Bally et al. | |
| 6,065,376 | A | | 5/2000 | Khachatoorian | |
| 6,101,908 | A | | 8/2000 | Azkona | |
| 6,116,124 | A | * | 9/2000 | Ping | 81/385 |
| 6,134,993 | A | | 10/2000 | Tally | |

(Continued)

FOREIGN PATENT DOCUMENTS

| | | | | |
|---|---|---|---|---|
| DE | 844128 | * | 7/1952 | 81/407 |

(Continued)

*Primary Examiner*—Joseph J. Hail, III
*Assistant Examiner*—Shantese L. McDonald
(74) *Attorney, Agent, or Firm*—Cook, Alex, McFarron, Manzo, Cummings & Mehler, Ltd.

(57) ABSTRACT

An adjustable pliers having first and second elongated members, each elongated member comprising a handle, a jaw, and a intermediate portion between the jaw and the handle. The intermediate portion of one of the elongated members includes an elongated slot, while the intermediate portion of the other elongated member includes a pivot pin that is slidingly captured in the elongated slot. A spring is captured in the elongated slot and engages the pivot pin so as to bias the jaw of one of the elongated members toward the jaw of the other elongated member. One of the handle members also includes a stop pin in its intermediate portion that abuts the intermediate portion of the other elongated member to limit the degree to which the elongated members can pivot with respect to each other about the pivot pin.

5 Claims, 2 Drawing Sheets

U.S. PATENT DOCUMENTS 6,145,415 A 11/2000 Liu
6,161,455 A 12/2000 Ping
6,178,855 B1 1/2001 Bally et al.
6,199,459 B1 3/2001 Azkona
6,212,978 B1 4/2001 Seber et al.

FOREIGN PATENT DOCUMENTS

GB 573204 * 11/1945 ..... 81/413

* cited by examiner

ADJUSTABLE PLIERS

BACKGROUND OF THE INVENTION

The present invention relates to adjustable pliers, and more particularly to a self-adjusting parallel jaw pliers.

Parallel jaw adjustable pliers are popular because of their utility in being able to securely hold variously-sized workpieces. The pliers generally provide for adjustability with a slip joint connecting one of the jaw/handle members to the other. However, a continuing problem has been providing for easy adjustment of the jaw spacing so as to permit single hand operation of the pliers.

Prior art pliers have tried to provide single hand operation by using a spring to bias the jaws away from each other. See, e.g. U.S. Pat. Nos. 5,660,089 to Chow 4,429,460 to Hill et al. This arrangement proves difficult to use with a single hand when the jaws are opened more widely than that needed for optimal gripping of the workpiece, and a second hand is required to move the jaws toward each other against the force of the spring. As can be readily appreciated, pliers that were intended to permit single hand operation are likely require two hands to properly space the jaw members for gripping the workpiece.

Accordingly, it is the principle art object of the present invention to provide and improve adjustable pliers.

More specifically, it is an object to the present invention to provide a parallel-jaw adjustable pliers that is adapted for single-hand operation.

It is a further object to provide a parallel-jaw adjustable pliers that automatically sizes the spacing between the jaws to accommodate the workpiece being grasped.

SUMMARY OF THE INVENTION

These objects, as well as others that will become apparent upon reference to the following detailed description and accompanying drawings, are provided by an adjustable pliers that includes first and second elongated members, each elongated member comprising a handle, a jaw, and a intermediate portion between the jaw and the handle. The intermediate portion of one of the elongated members includes an elongated slot, while the intermediate portion of the other elongated member includes a pivot pin that is slidingly captured in the elongated slot. Thus, the elongated members are pivotable about the pivot pin with respect to each other to permit the jaws to be selectively opened or closed about a workpiece, and are also slidable with respect to each other along the elongated slot to adjust the spacing between the jaws. A spring is captured in the elongated slot and engages the pivot pin so as to bias the jaw of one of the elongated members toward the jaw of the other elongated member. In the preferred embodiment, one of the handle members also includes a stop pin in its intermediate portion that abuts the intermediate portion of the other elongated member to limit the degree to which the elongated members can pivot with respect to each other about the pivot pin. A stop pin may nest in a serrated portion on the intermediate portion that it abuts to more positively locate the pin.

DETAILED DESCRIPTION

Figure 1:
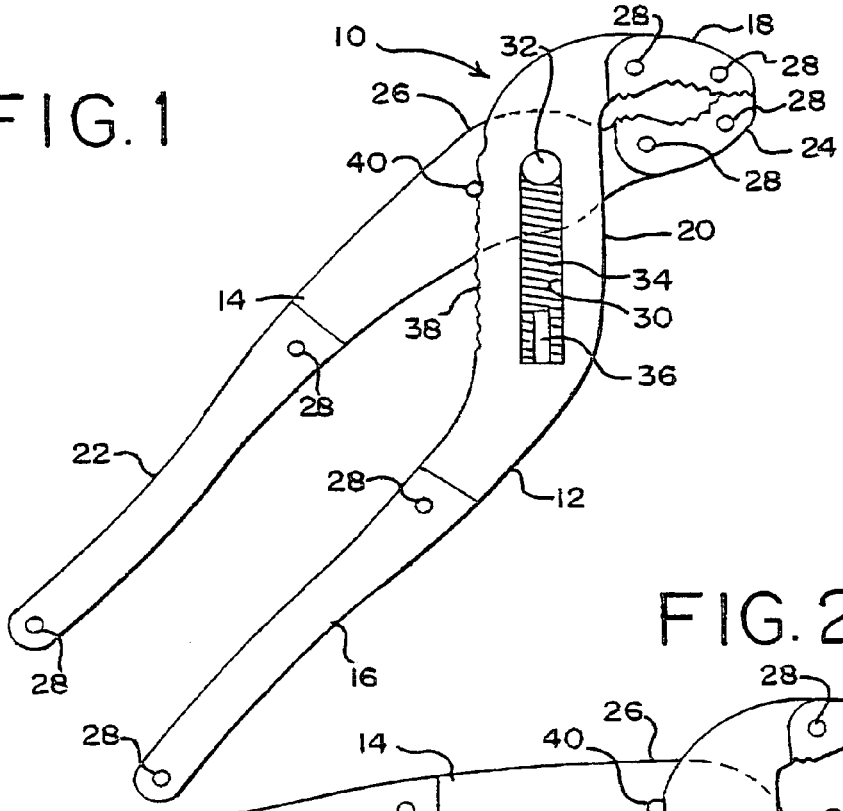
FIG. 1 is a plan view of a pliers according to the present invention with the jaws in the closed position.

Turning to the drawings, there is seen a parallel jaw adjustable pliers, generally designated 10, in accordance with the present invention. The pliers includes a pair of generally elongated members 12, 14. The elongated member 12 includes a handle portion 16, a jaw 18, and a intermediate portion 20 connecting the handle 16 to the jaw 18. Similarly, the elongated member 14 includes a handle portion 22 a jaw 24, and a intermediate portion 26 connecting the handle 22 to the jaw 26. The elongated members 12, 14 are preferably made of a plurality of metal plates held together by, e.g., rivets 28. Alternatively, the elongated members 12,14 may be made by forging, casting, or stamping. Also, the handle portions of the elongated members are preferably provided with a cushion grip.

The intermediate portions 20, 26 of the two elongated members 12, 14, respectively, are joined together in the well-known manner by a slip joint that permits both pivotal and sliding movement of the elongated members with respect to each other. The slip joint permits the usage to adjust the distance between the jaw members to accommodate various-sized workpieces (by sliding motion) and to close the jaws on the workpiece (by pivoting motion). Accordingly, the intermediate portion 20 of the elongated member 12 includes an elongated slot 30 that captures a pivot pin 32 in the intermediate portion 26 of the other elongated member 14. The pivot pin 32 is preferably a rivet(as shown), but may alternatively comprise, e.g., a nut and bolt.

In keeping with the invention, the pliers 10 includes a resilient member for biasing the jaws toward each other. With reference to the drawings, a coil spring 34 is provided that is located in the slot 30 that engages the pivot pin 32 so as to force the pivot pin (and its associated elongated member 14 and jaw 24) toward the upper end of the slot 30 closest to the jaw 18. The lower end of the slot 30, or that farthest away from the jaw 18, includes a spring retainer in the form of a post 34 over which the spring 36 nests.

The pliers 10 also includes a series of grooves or notches 38 on the intermediate portion 20 of the elongated member 12 that cooperate with a stop pin or post 40 in the intermediate portion 26 of the elongated member 14. The pin 40 seats in one of the notches 38 when the jaws 18, 24 are closed on a workpiece to provide "self-sizing" of the space between the jaws 18, 24, thus permitting the pliers 10 to accommodate a range of sizes of workpieces.

Figure 2:
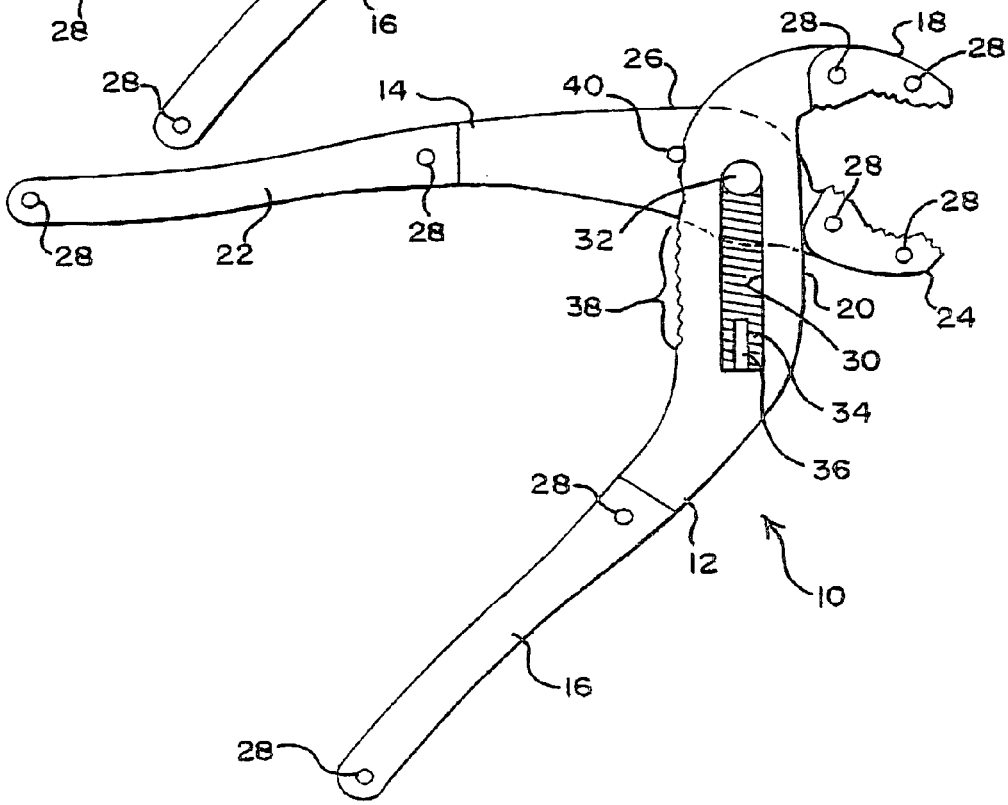
FIG. 2 is a plan view of a pliers according to the present invention with the jaws in the open position.
Figure 3:
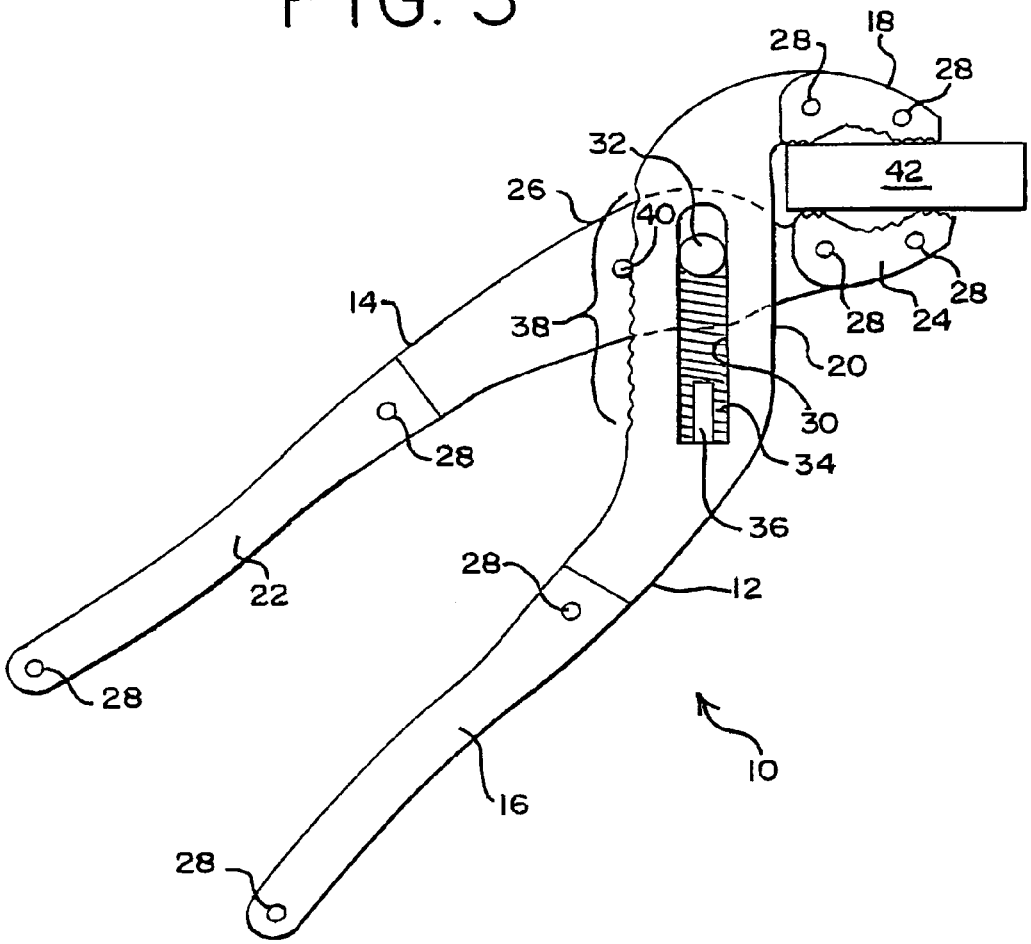
FIG. 3 is a plan view of the pliers according to the present invention with the jaws closed on a workpiece.

As better understood with reference to FIGS. 2 and 3, the jaws 18, 24 are opened to receive a workpiece 42 (FIG. 3), with the pivot pin 32 at the top of the slot 30 and the jaws at their smallest opening. If the workpiece has a dimension such that, with the pivot pin 32 at the top of the slot 30, the jaw surfaces cannot be parallel when gripping the workpiece, the pivot pin 32 will slide down the slot (FIG. 3) to open the jaw an amount sufficient to permit the jaws to be parallel when gripping the workpiece 42. The spring 34 insures that the pivot pin slides down the slot 30 no further than that needed to accommodate the workpiece between parallel jaw surfaces. At the same time, the stop pin 40 will nest in the appropriate groove 38 to provide a positive locking of the location of the pivot pin 32 in the slot 30 for the appropriate spacing of the jaws to accommodate the workpiece 42.

Thus, an adjustable pliers has been provided that meets all the objects of the present invention. While the invention has been described in terms of a preferred embodiment, there is no intent to limit it to the same. Instead, the invention is defined by the following claims.

The invention claimed is:

1. An self-adjusting pliers comprising;

first and second elongated members, each elongated member comprising a handle, a jaw with a gripping surface, and an intermediate portion between the handle and the jaw;

the intermediate portion of the first elongated member including an elongated slot having a first end adjacent the jaw associated with the first member and a second end spaced from the first end;

the intermediate portion of a second elongated member including a pivot pin that is slidingly captured in the elongated slot, the first elongated member being pivotable about the pivot pin to permit the jaws to be selectively opened or closed about a work piece and being slidable along the elongated slot to adjust the spacing between the jaws;

the second elongated member including a stop pin in its intermediate portion that is adapted to abut the intermediate portion of the first elongated member and the intermediate portion of the first elongated member including a series of notches external to the elongated slot so that the stop pin of the second elongated member nests in a notch when it abuts the intermediate portion of the first elongated member to maintain the relative spacing of the jaws and to limit the degree to which the second elongated member can pivot about the pivot pin; and a single spring captured in the elongated slot between the pivot pin and the second end of the slot and engaging the pivot pin so as to bias the jaw of the second elongated member toward the jaw of the first elongated member, whereby when the jaws are closed to grip a workpiece, the second elongated member moves toward the second end of the slot against the force of the spring to the extent necessary to accommodate the workpiece with the gripping surfaces of the jaws being substantially parallel.

2. The adjustable pliers of claim 1 further comprising a spring retainer located in the elongated slot of the first elongated member.

3. The adjustable pliers of claim 2 wherein the spring comprises a coil spring and the spring retainer comprises a post over which the coil spring nests.

4. The adjustable pliers in claim 1 wherein the first and second elongated members each comprises a plurality of plates that are secured together.

5. The adjustable pliers in claim 4 wherein the plates are secured together by rivets.

* * * * *